US008435090B1

(12) United States Patent
Lonnborg et al.

(10) Patent No.: US 8,435,090 B1
(45) Date of Patent: May 7, 2013

(54) MARINE DRIVES AND METHODS OF OPERATING MARINE DRIVES HAVING A LUBRICANT EXCLUSION COVER

(75) Inventors: Thomas S. Lonnborg, Fond du Lac, WI (US); Randall J. Poirier, Howards Grove, WI (US); Neil A. Rothe, Campbellsport, WI (US)

(73) Assignee: Brunswick Corporation, Lake Forest, IL (US)

( * ) Notice: Subject to any disclaimer, the term of this patent is extended or adjusted under 35 U.S.C. 154(b) by 107 days.

(21) Appl. No.: 12/987,762

(22) Filed: Jan. 10, 2011

(51) Int. Cl.
*B63H 20/32* (2006.01)

(52) U.S. Cl.
USPC ..... 440/78

(58) Field of Classification Search ..... 440/75, 440/83, 78
See application file for complete search history.

(56) References Cited

U.S. PATENT DOCUMENTS

| | | | | |
|---|---|---|---|---|
| 2,495,169 | A * | 1/1950 | Jennings et al. | 114/20.1 |
| 3,108,815 | A * | 10/1963 | Haynie et al. | 277/551 |
| 4,373,922 | A * | 2/1983 | Weed | 440/89 A |
| 4,792,313 | A | 12/1988 | Meisenburg | |
| 5,271,676 | A * | 12/1993 | Keck et al. | 384/111 |
| 6,319,081 | B1 * | 11/2001 | Davis | 440/112 |
| 6,770,007 | B2 * | 8/2004 | Fox | 475/348 |

* cited by examiner

*Primary Examiner* — Stephen Avila
(74) *Attorney, Agent, or Firm* — Andrus, Sceales, Starke & Sawall, LLP

(57) ABSTRACT

A marine drive comprises a gear case housing a vertical driveshaft that rotates a generally horizontal propulsor shaft in a forward direction upon operational engagement with a forwardly rotatable gear and a rearward direction upon operational engagement with a rearwardly rotatable gear. A lubricant exclusion cover is disposed between the forwardly and rearwardly rotatable gears so as to limit churning of lubricant by at least one of the forwardly and rearwardly rotatable gears.

12 Claims, 6 Drawing Sheets

MARINE DRIVES AND METHODS OF OPERATING MARINE DRIVES HAVING A LUBRICANT EXCLUSION COVER

FIELD

The present disclosure relates to marine drives, and particularly marine drives having a gear case with an internal lubricant-containing cavity.

BACKGROUND

U.S. Pat. No. 4,792,313 discloses a marine drive having a lower gear case with a torpedo housing having an internal lubricant-containing cavity.

Pending U.S. patent application Ser. No. 12/899,698 is incorporated herein by reference and discloses a marine drive lower gear case having a torpedo housing with an internal cavity holding lubricant for lubricating gears and bearings in the gear case.

SUMMARY

The present disclosure results from the inventors' research and development of marine drives having a gear case housing a vertical driveshaft that rotates a generally horizontal propulsor shaft. Such gear cases are typically filled with enough lubricant or oil to keep an upper driveshaft bearing lubricated. Rotatable gears that are submerged in the lubricant have been found by the inventors to create excessive churning of the lubricant, undesirably resulting in excessive heat, power loss, and potentially foaming of the lubricant.

In one example of the present disclosure, a marine drive comprises a gear case housing a vertical driveshaft that rotates a generally horizontal propulsor shaft in a forward direction upon operational engagement with a forwardly rotatable gear and a rearward direction upon operational engagement with a rearwardly rotatable gear. A lubricant exclusion cover is disposed between the forwardly and rearwardly rotatable gears so as to limit lubricant impingement on at least one of the gears.

In a further example, a lubricant exclusion cover comprises a frame having a front surface for disposition next to a forwardly rotatable gear in a lower gear case of a marine drive and a rear surface for disposition next to a rearwardly rotatable gear in the lower gear case.

In a further example, a method of operating a marine drive comprises operating a vertical driveshaft to rotate a generally horizontal propulsor shaft in a forward direction upon operational engagement with a forwardly rotatable gear and a rearward direction upon operational engagement with a rearwardly rotatable gear. Lubricant impingement on at least one of the forwardly and rearwardly rotatable gears is limited by disposing a lubricant exclusion cover between the gears.

DETAILED DESCRIPTION OF THE DRAWINGS

Figure 1:
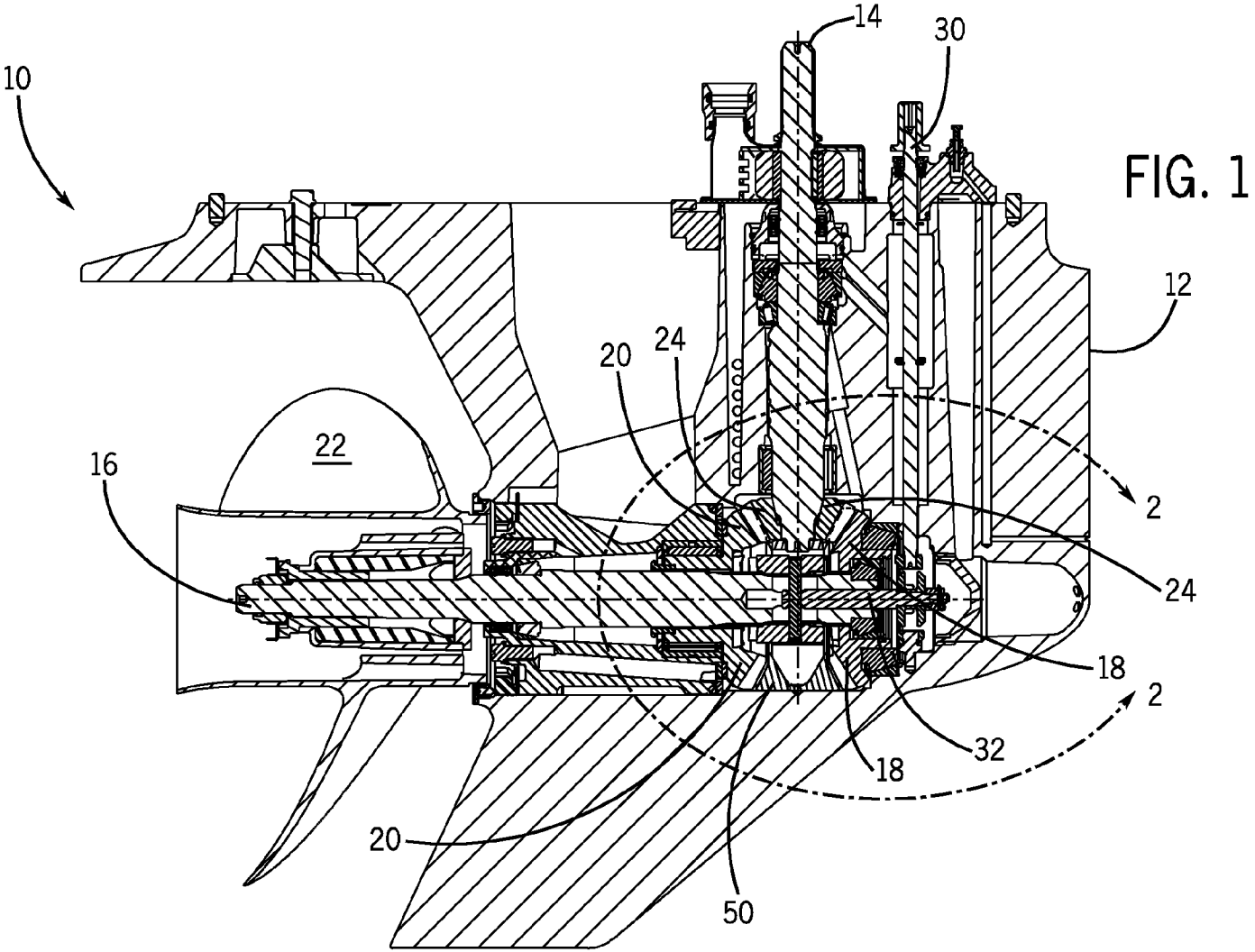
FIG. 1 is a side sectional view of a marine drive gear case.

In the present description, certain terms have been used for brevity, clearness and understanding. No unnecessary limitations are to be implied therefrom beyond the requirement of the prior art because such terms are used for descriptive purposes only and are intended to be broadly construed. The systems and methods described herein may be used alone or in combination with other systems and methods. Various equivalents, alternatives and modifications are possible within the scope of the appended claims. Each element in the appended claims is intended in invoke interpretation under 35 U.S.C. §112, sixth paragraph, only if the terms "means for" or "step for" are explicitly recited in the respective element.

FIGS. 1-3, 5 and 6 depict a marine drive 10 having a gear case 12 housing a vertical driveshaft 14 that extends into the gear case 12 and rotates a generally horizontal propulsor shaft 16 in a forward direction upon operational engagement with a forwardly rotatable gear 18 and a rearward direction upon operational engagement with a rearwardly rotatable gear 20. The propulsor shaft 16 is connected to a propulsor 22, which in the example shown is a propeller. In other examples, the propulsor could include, for example, an impeller or other means for providing propulsive force to a marine vessel (not shown). Rotation of the propulsor shaft 16 in a forward direction causes forward rotation of the propulsor 22, whereas rotation of the propulsor shaft 16 in a rearward direction causes rearward rotation of the propulsor 22.

Figure 2:
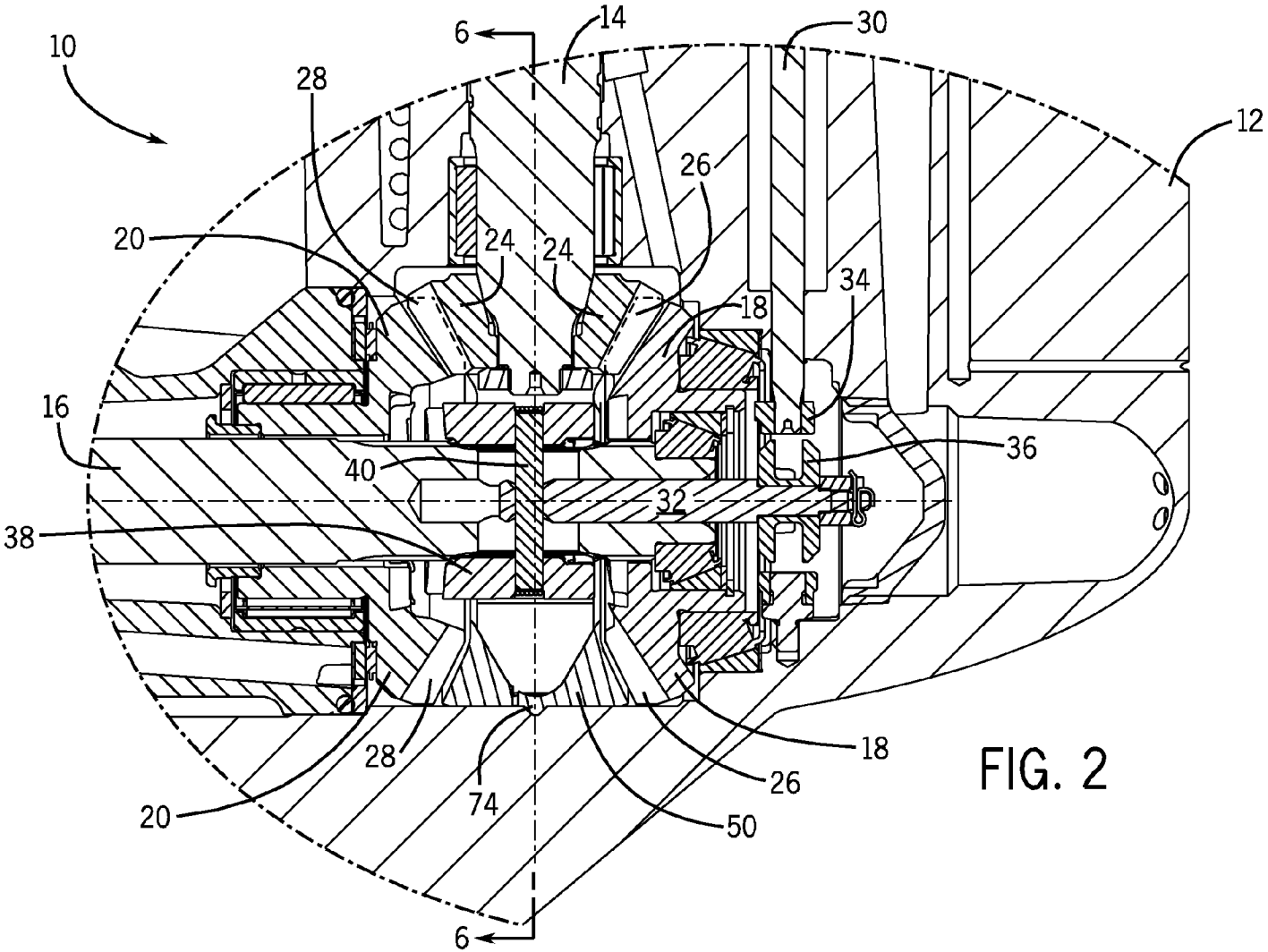
FIG. 2 is an enlarged view of Section 2-2 taken in FIG. 1.
Figure 3:
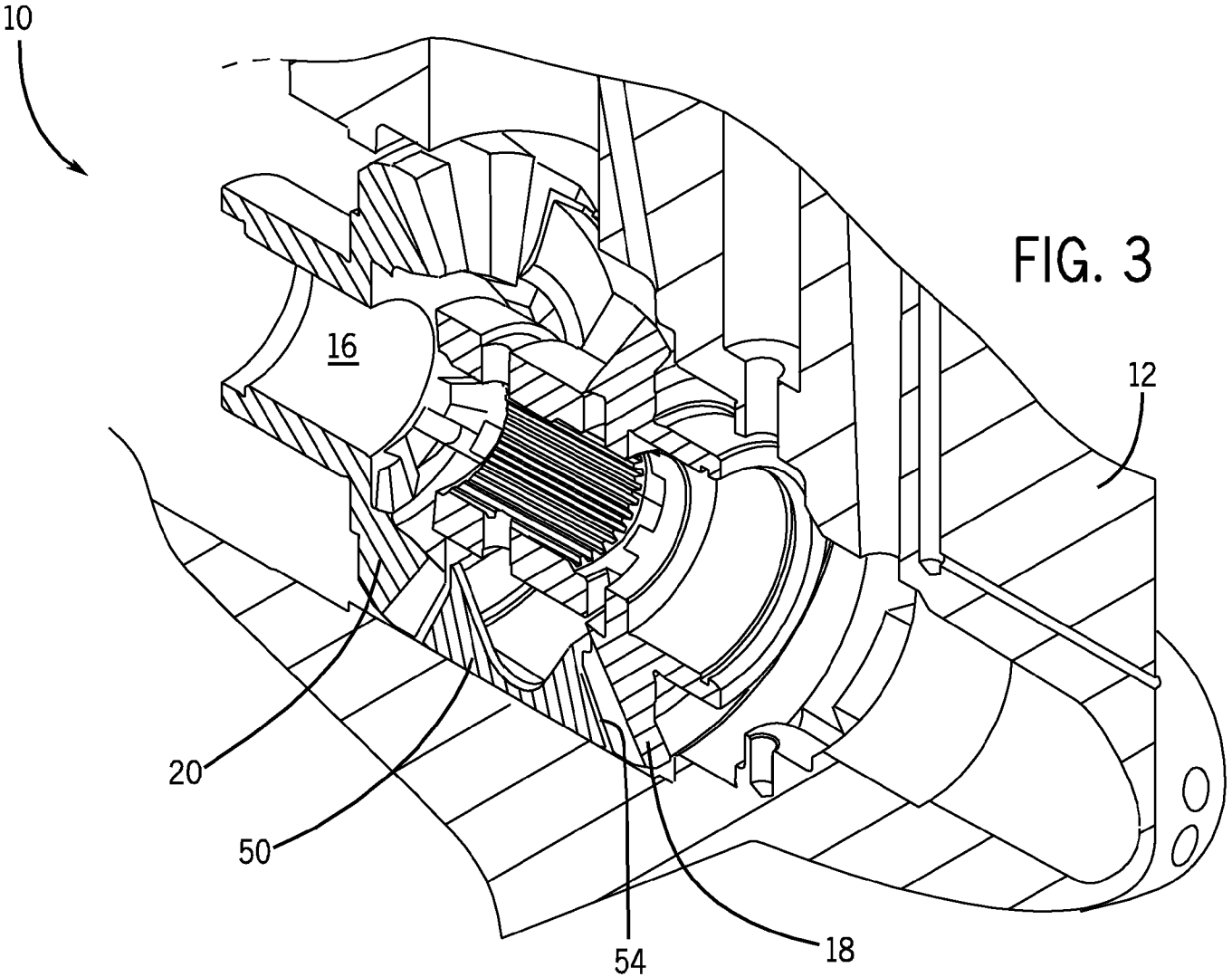
FIG. 3 is a sectional view, partially cut away, showing a lubricant exclusion cover in the marine drive gear case.

The driveshaft 14 is driven by an internal combustion engine, an electrical motor, hybrid arrangement, and/or the like (not shown) into continuous counterclockwise rotation. A pinion 24 disposed on the lower end of driveshaft 14 spins with the driveshaft 14 and continuously drives the forwardly rotatable gear 18 into forward rotation and the rearwardly rotatable gear 20 into rearward rotation. The pinion 24 is connected to the forwardly rotatable gear 18 via meshed gear teeth 26 and to the rearwardly rotatable gear 20 by meshed gear teeth 28. As shown in FIG. 2, a shift shaft 30 extends into the gear case 12 and is connected to a shift spool shaft 32 via a shift crank 34 and shift spool 36. A clutch 38 is connected to the shift spool shaft 32 via cross pin 40. Rotation of the shift shaft 30 in one direction pulls the clutch 38 forwardly so as to engage the forwardly rotatable gear 18. Rotation of the shift shaft 30 in the opposite direction pushes the clutch 38 rearwardly so as to engage the rearwardly rotatable gear 20. The clutch 38 is connected to the propulsor shaft 16 such that engaging the forwardly rotatable gear 18 forwardly rotates the propulsor shaft 16 and engaging the rearwardly rotatable gear 20 rearwardly rotates the propulsor shaft 16. FIGS. 1 and 2 depict the clutch 38 in a neutral position wherein both the forwardly rotatable gear 18 and rearwardly rotatable gear 20 are rotatable and the propulsor shaft 16 is stationary.

A lubricant exclusion cover 50 is disposed between the forwardly rotatable gear 18 and rearwardly rotatable gear 20 so as to limit lubricant impingement on at least one of the forwardly rotatable gear 18 and rearwardly rotatable gear 20. The lubricant exclusion cover 50 can have a variety of configurations and can vary significantly from the configuration shown in the drawings. In the example shown in FIGS. 4-6, the lubricant exclusion cover 50 includes a frame 52 having a front surface 54 located adjacent the forwardly rotatable gear 18 and a rear surface 56 located adjacent the rearwardly rotatable gear 20. A radial framework 58 extends between the front surface 54 and rear surface 56, and specifically from an outer edge 60 of the front surface 54 to an outer edge 62 of the rear surface 56. Each of the front surface 54 and rear surface 56 is tapered inwardly so as to align with the forwardly rotatable gear 18 and rearwardly rotatable gear 20. The configuration of the front surface 54 and rear surface 56 can vary depending upon the particular configuration of forwardly and rearwardly rotatable gears 18, 20. In the example shown, the front surface 54 and rear surface 56 have three tapered sections 57*a*, 57*b*, 57*c*, each tapering at an increasing angle away from the outer edges 60, 62 of the respective surface 54, 56.

Figure 6:
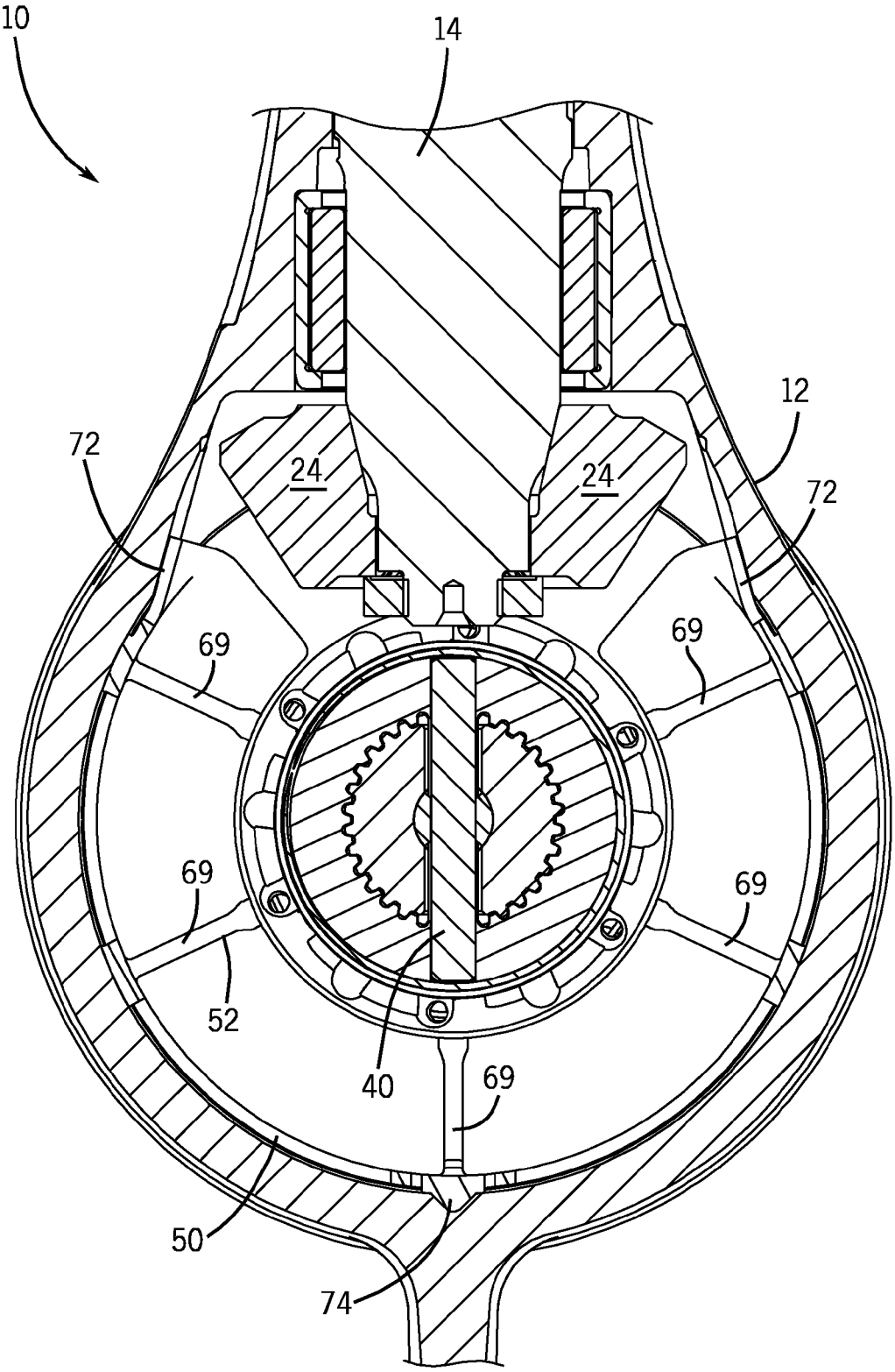
FIG. 6 is a view of Section 6-6 taken in FIG. 2.

In the example shown, the frame 52 is generally cylindrical in shape and generally C-shaped in cross-section so as to define inwardly opposing end portions 64, 66. According to this arrangement, the lubricant exclusion cover 50 can be disposed adjacent both of the forwardly rotatable gear 18 and rearwardly rotatable gear 20. Further, the general cross-sectional shape of the frame 52 advantageously disposes the inwardly opposing end portions 64, 66 at a location proximate to and between the forwardly and rearwardly rotatable gears 18, 20 and the pinion 24, thus reducing lubricant impingement of the forwardly and rearwardly rotatable gears 18, 20 and the pinion 24 (see FIG. 6). A pair of flexible tabs 72 extends radially outwardly from the opposing end portions 64, 66 to allow for insertion of the cover 50 into its position in the gear case 12. During insertion, the tabs 72 are flexed inwardly. Once the cover 50 is registered in its position in the gear case 12, the flexible tabs 72 flex back outwardly to retain the cover 50 in place by friction fit. Referring to FIG. 6, a downwardly extending protrusion 74 is registered in a recess in gear case 12 to provide further stability and retain the cover 50 in place.

Figure 4:
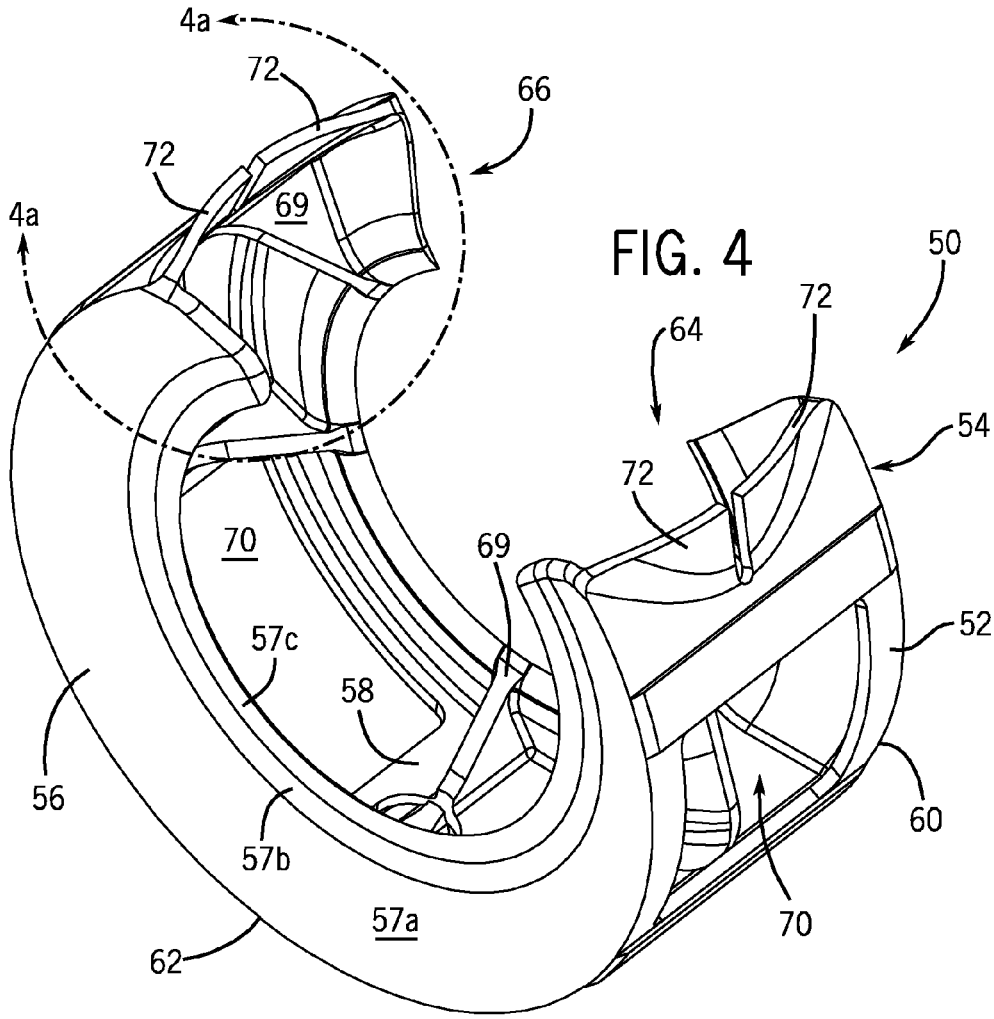
FIG. 4 is perspective view of a lubricant exclusion cover.
Figure 4A:
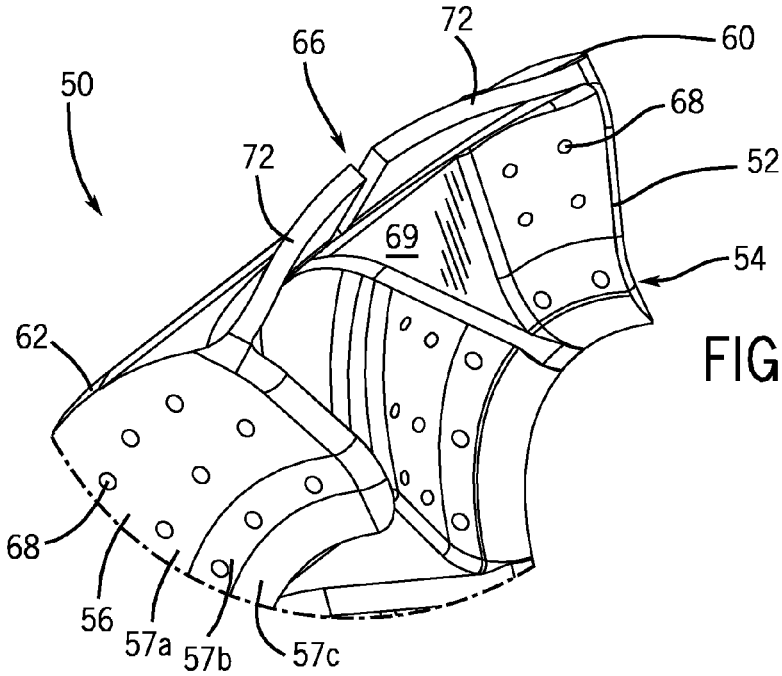
FIG. 4*a* is a view of Section 4*a*-4*a* taken in FIG. 4.
Figure 5:
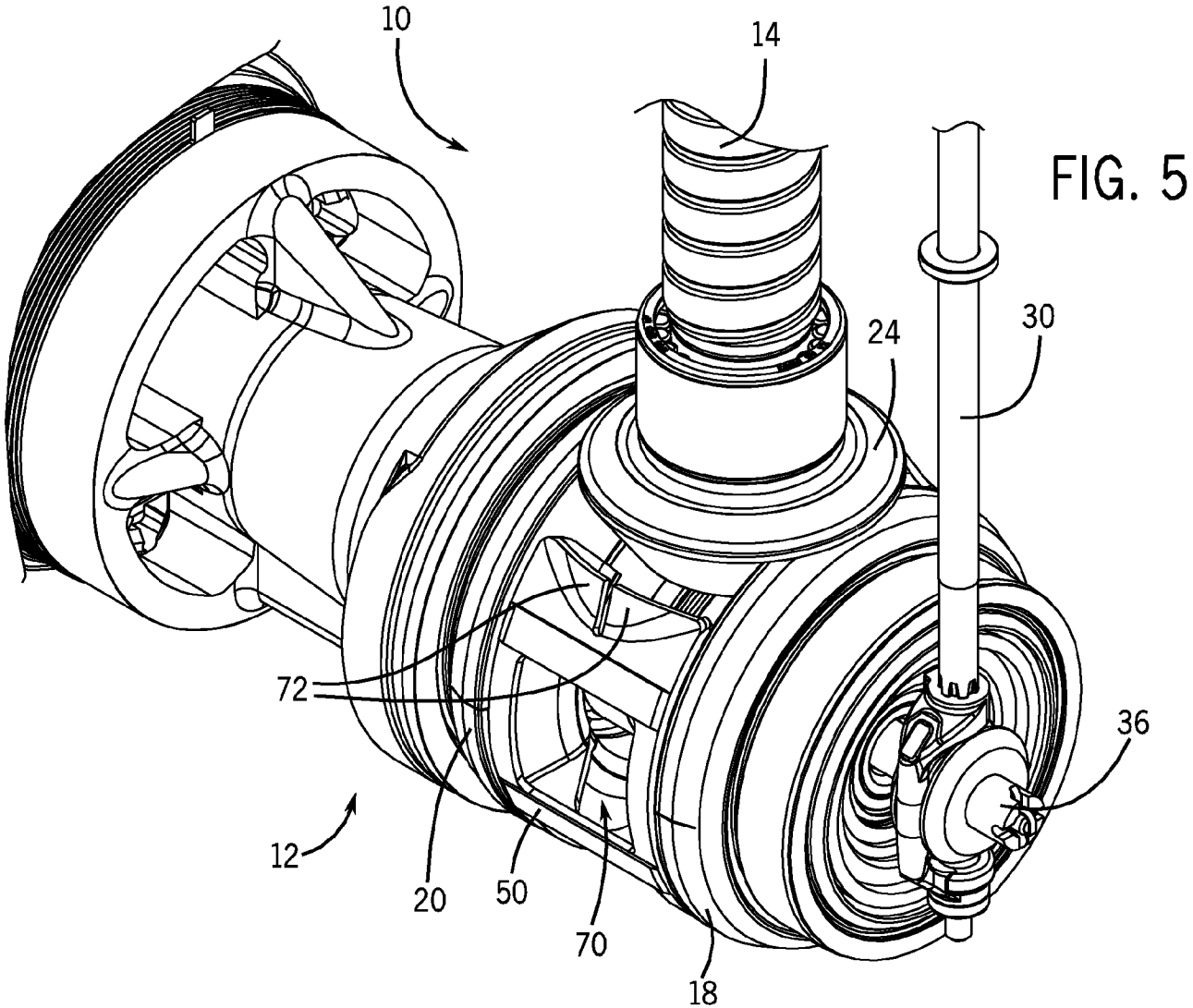
FIG. 5 is a perspective view of a vertical driveshaft for engaging with forwardly and rearwardly rotatable gears having a lubricant exclusion cover disposed therebetween.

In the example of FIG. 4*a*, the front surface 54 and rear surface 56 can define a predetermined number (one or more) of apertures 68 large enough to allow passage of lubricant therethrough. In another example, the radial framework 58 can define a predetermined number (one or more) of apertures 70 large enough to allow passage of lubricant therethrough. The apertures 70 shown in FIG. 4 are larger than the apertures 68 shown in FIG. 4*a*. The size and configuration of apertures 68, 70 can vary from that shown and can be configured to control the amount of lubricant introduced to the meshed gear teeth 26, 28, and the amount of lubricant exposure to the surrounding gear case 12 for cooling, thus optimizing lubrication and increasing gear life. A plurality of stiffening ribs 69 is provided to strengthen the frame 52.

The lubricant exclusion cover 50 has been found to limit impingement of lubricant in a marine drive. For example, disposition of the lubricant exclusion cover 50 between the forwardly rotatable gear 18 and rearwardly rotatable gear 20 prevents the gears 18, 20 from churning oil, thereby reducing heat and power loss and extending gear life. This arrangement has been found to allow for operation at higher gear pitch line velocities without the need for high temperature synthetic lubricants, thus reducing cost.

What is claimed is:

1. A marine drive comprising:

a lubricant-containing gear case housing a vertical driveshaft that rotates a generally horizontal propulsor shaft in a forward direction upon operational engagement with a forwardly rotatable gear and a rearward direction upon operational engagement with a rearwardly rotatable gear that is spaced apart from the forwardly rotating gear; and a lubricant exclusion cover disposed in the gear case housing between the forwardly and rearwardly rotatable gears so as to limit lubricant impingement on at least one of the forwardly and rearwardly rotatable gears;

wherein the lubricant exclusion cover is disposed adjacent to at least one of the forwardly and rearwardly rotatable gears; and wherein the lubricant exclusion cover defines at least one aperture large enough to allow passage of lubricant therethrough.

2. A marine device according to claim 1, wherein the lubricant exclusion cover is disposed adjacent to both of the forwardly and rearwardly rotatable gears.

3. A marine drive comprising;

a lubricant-containing gear case housing a vertical driveshaft that rotates a generally horizontal propulsor shaft in a forward direction upon operational engagement with a forwardly rotatable gear and a rearward direction upon operational engagement with a rearward rotatable gear that is spaced apart from the forwardly rotating gear; and a lubricant exclusion cover disposed in the gear case housing between the forwardly and rearwardly rotatable gears so as to limit lubricant impingement on at least one of the forwardly and rearwardly rotatable gears;

wherein the lubricant exclusion cover is disposed adjacent to at least one of the forwardly and rearwardly rotatable gears; and wherein the lubricant exclusion cover comprises a frame having a front surface located adjacent to the forwardly rotatable gear and a rear surface located adjacent to the rearwardly rotatable gear.

4. A marine drive comprising:

a gear case housing a vertical driveshaft that rotates a generally horizontal propulsor shaft in a forward direction upon operational engagement with a forwardly rotatable gear and a rearward direction upon operational engagement with a rearwardly rotatable gear; and a lubricant exclusion cover disposed between the forwardly and rearwardly rotatable gears so as to limit lubricant impingement on at least one of the forwardly and rearwardly rotatable gears;

wherein the lubricant exclusion cover is disposed adjacent to at least one of the forwardly and rearwardly rotatable gears;

wherein the lubricant exclusion cover comprises a frame having a front surface located adjacent to the forwardly rotatable gear and a rear surface located adjacent to the rearwardly rotatable gear;

wherein the forward and rear surfaces are tapered inwardly.

5. A marine drive according to claim 3, wherein least one of the front surface and rear surface defines at least one aperture large enough to allow passage of lubricant therethrough.

6. A marine drive comprising:

a gear case housing a vertical driveshaft that rotates a generally horizontal propulsor shaft in a forward direction upon operational engagement with a forwardly rotatable gear and a rearward direction upon operational engagement with a rearwardly rotatable gear; and a lubricant exclusion cover disposed between the forwardly and rearwardly rotatable gears so as to limit lubricant impingement on at least one of the forwardly and rearwardly rotatable gears;

wherein the lubricant exclusion cover is disposed adjacent to at least one of the forwardly and rearwardly rotatable gears;

wherein the lubricant exclusion cover comprises a frame having a front surface located adjacent to the forwardly rotatable gear and a rear surface located adjacent to the rearwardly rotatable gear;

wherein the frame comprises a radial framework extending between the forward and rear surfaces.

7. A marine drive according to claim 6, wherein the radial framework extends from an outer edge of the front surface to an outer edge of the rear surface.

8. A marine drive according to claim 6, wherein the radial framework defines at least one aperture large enough to allow passage of lubricant therethrough.

9. A marine drive according to claim 3, wherein the frame is generally cylindrical in shape.

10. A marine drive according to claim 9, wherein the frame is generally C-shaped in cross section.

11. A marine drive comprising:

a gear case housing a vertical driveshaft that rotates a generally horizontal propulsor shaft in a forward direction upon operational engagement with a forwardly rotatable gear and a rearward direction upon operational engagement with a rearwardly rotatable gear; and a lubricant exclusion cover disposed between the forwardly and rearwardly rotatable gears so as to limit lubricant impingement on at least one of the forwardly and rearwardly rotatable gears;

wherein the lubricant exclusion cover is disposed adjacent to at least one of the forwardly and rearwardly rotatable gears;

wherein the lubricant exclusion cover comprises a frame having a front surface located adjacent to the forwardly rotatable gear and a rear surface located adjacent to the rearwardly rotatable gear;

wherein the frame is generally cylindrical in shape;

wherein the frame is generally C-shaped in cross section;

wherein the lubricant exclusion cover has inwardly opposing end portions, wherein at least one of the inwardly opposing end portions is disposed between at least one of the forwardly and rearwardly rotatable gears and a pinion operatively connecting the drive shaft to the at least one of the forwardly and rearwardly rotatable gears.

12. A marine drive comprising;

a lubricant-containing gear case housing a vertical driveshaft that rotates a generally horizontal propulsor shaft in a forward direction upon operational engagement with a forwardly rotatable gear and a rearward direction upon operational engagement with a rearwardly rotatable gear that is spaced apart from the forwardly rotating gear; and a lubricant exclusion cover disposed in the gear case housing between the forwardly and rearwardly rotatable gears so as to limit lubricant impingement on at least one of the forwardly and rearwardly rotatable gears;

wherein the lubricant exclusion cover comprises a portion having a tapered front surface located adjacent to the forwardly rotatable gear and another portion having a tapered rear surface oppositely oriented with respect to the front surface and located adjacent to the rearwardly rotatable gear.

* * * * *